US008801396B2

(12) United States Patent
Sundquist

(10) Patent No.: US 8,801,396 B2
(45) Date of Patent: Aug. 12, 2014

(54) OIL PUMP SYSTEM FOR AN ENGINE

(75) Inventor: Walter W. Sundquist, Brighton, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 680 days.

(21) Appl. No.: 13/153,901

(22) Filed: Jun. 6, 2011

(65) Prior Publication Data

US 2011/0297259 A1 Dec. 8, 2011

Related U.S. Application Data

(60) Provisional application No. 61/351,457, filed on Jun. 4, 2010.

(51) Int. Cl.
*F01M 1/20* (2006.01)
*F04C 14/26* (2006.01)
*F16K 17/04* (2006.01)

(52) U.S. Cl.
USPC .... 417/310; 137/516.27; 137/538; 123/196 R

(58) Field of Classification Search
CPC ..... F01M 1/16; F01M 1/20; F04B 49/08; F04C 14/24; F04C 14/26; F16K 17/085; F16K 17/0473
USPC ..... 137/538, 516.27; 123/196 R; 417/307, 417/310
See application file for complete search history.

(56) References Cited

U.S. PATENT DOCUMENTS 1,844,668 A * 2/1932 McGregor ..... 137/538
2,011,333 A * 8/1935 Clifton ..... 137/538
2,305,519 A * 12/1942 Dunmire ..... 137/538
3,146,720 A * 9/1964 Henry ..... 417/310
3,373,689 A * 3/1968 Brunson ..... 417/310
5,338,161 A 8/1994 Eley
5,547,349 A 8/1996 Kimura et al.
5,722,815 A * 3/1998 Cozens ..... 417/310
5,738,501 A 4/1998 Eisenmann
5,797,732 A 8/1998 Watanabe et al.
5,857,442 A 1/1999 Sumi
5,918,573 A 7/1999 Killion
6,004,111 A * 12/1999 Miyazaki et al. ..... 417/310
6,086,337 A 7/2000 Watanabe et al.
6,168,391 B1 1/2001 Ono
6,296,456 B1 10/2001 Thomelow et al.
6,352,085 B1 * 3/2002 Morita et al. ..... 137/516.27

(Continued)

FOREIGN PATENT DOCUMENTS

JP 2005/140022 A 6/2005

*Primary Examiner* — John Rivell

(74) *Attorney, Agent, or Firm* — Ralph E Smith

(57) ABSTRACT

An oil pump system can include a housing defining a pocket for an oil pump, a cavity, and a pump outlet passage connecting the pocket to the cavity. Low and high pressure relief passages can be defined by the housing for selectively fluidly coupling the cavity to a pressure relief area. A pressure relief valve positioned in the cavity can comprise first and second ends, first and second internal bores, and a slot in communication with the first internal bore. A biasing member positioned in the second internal bore can biasing the valve to a first position. The valve can translate to a second position aligning the slot with the low pressure relief passage to selectively provide low pressure relief to the oil pump, and can translate to a third position aligning the slot with the high pressure relief passage to selectively provide high pressure relief to the oil pump.

19 Claims, 7 Drawing Sheets

(56) References Cited

U.S. PATENT DOCUMENTS

| | | | | |
|---|---|---|---|---|
| 6,481,458 | B2 * | 11/2002 | Hirano et al. | 137/538 |
| 6,488,479 | B1 | 12/2002 | Berger | |
| 6,616,419 | B2 | 9/2003 | Watanabe et al. | |
| 6,709,242 | B2 | 3/2004 | Mochiyama et al. | |
| 6,739,305 | B2 | 5/2004 | Takahara et al. | |
| 6,763,797 | B1 | 7/2004 | Staley et al. | |
| 7,011,069 | B2 | 3/2006 | Ono et al. | |
| 7,281,906 | B2 | 10/2007 | Tanikawa et al. | |
| 7,387,136 | B2 * | 6/2008 | Kuroda | 137/516.27 |
| 7,588,011 | B2 | 9/2009 | Ono et al. | |
| 8,038,417 | B2 * | 10/2011 | Yamamoto et al. | 417/310 |
| 2005/0098385 | A1 | 5/2005 | Ono et al. | |
| 2007/0062582 | A1 * | 3/2007 | Ohtsuki et al. | 137/538 |
| 2010/0078085 | A1 * | 4/2010 | Kurokawa et al. | 137/528 |
| 2012/0260884 | A1 * | 10/2012 | Kwon et al. | 123/196 R |
| 2013/0014838 | A1 * | 1/2013 | Akaishi et al. | 137/538 |

* cited by examiner

OIL PUMP SYSTEM FOR AN ENGINE

CROSS-REFERENCE TO RELATED APPLICATIONS

This application claims the benefit of U.S. Provisional Application No. 61/351,457, filed on Jun. 4, 2010, the disclosure of which is hereby incorporated herein by reference.

FIELD

The present disclosure relates generally to an oil pump system for an engine and, more particularly, to an oil pump with a pressure relief valve for an engine.

BACKGROUND

Motor vehicles typically include an internal combustion engine and an associated lubrication system for providing lubricating oil to various areas of the engine. The various areas can include bearings that support rotating shafts, such as a crankshaft and a camshaft, for example. The engine typically requires a certain flow rate of oil to be delivered to these various areas within a certain range of pressure, where the flow rate and pressure vary depending on the engine speed (i.e., crankshaft rotation speed). A conventional fixed displacement oil pump can be used to deliver lubricating oil to the various lubrication areas. However, such a conventional fixed displacement oil pump can produce less oil pressure than desired when operating at a high engine temperature and low engine speed condition. In addition, the fixed displacement oil pump can also produce excessively high oil pressure when operating at a high engine speed and low engine temperature condition. Increasing the displacement of such a fixed displacement pump to improve the oil pressure at the high temperature and low engine speed operating condition can result in more power consumption and thus a degradation in fuel economy while also increasing the oil pressure at the high engine speed and low temperature condition.

Thus, while fixed displacement oil pumps work for their intended purpose, there remains a need for continuous improvement in the relevant art.

SUMMARY

In one form, an oil pump system for an engine is provided in accordance with the teachings of the present disclosure. The oil pump system can include an oil pump housing, a low pressure and a high pressure relief passage, a pressure relief valve and a biasing member. The oil pump housing can define a pocket configured to receive an oil pump therein, a cavity, and an oil pump outlet passage connecting the pocket to a first end of the cavity. The low pressure relief passage can be defined by the pump housing for selectively fluidly coupling the cavity to a pressure relief area defined by the pump housing and adapted to be in fluid communication with an oil sump. The high pressure relief passage can be defined by the pump housing for selectively fluidly coupling the cavity to the pressure relief area. The pressure relief valve can be positioned in the cavity and can comprise a body having a first end, a second opposite end, a first internal bore extending from the valve first end, a second internal bore extending from the valve second end, and at least one slot positioned in the body in communication with the first internal bore. The biasing member can be positioned in the second internal bore and can bias the pressure relief valve to a first position. The pressure relief valve can be configured to overcome a biasing force of the biasing member and translate to a second position aligning the at least one slot with the low pressure relief passage to selectively provide low pressure relief to the oil pump in response to pressurized oil from the pump outlet passage flowing into the first internal bore being greater than a first predetermined pressure value. The pressure relief valve can be configured to further translate to a third position aligning the at least one slot with the high pressure relief passage to selectively provide high pressure relief to the oil pump in response to pressurized oil from the pump outlet passage being greater than a second predetermined pressure value.

In another form, an oil pump system for an engine is provided in accordance with the teachings of the present disclosure. The oil pump system can include a fixed displacement oil pump, an oil pump housing, a low pressure and a high pressure relief passage, an annular pressure relief valve and a biasing member. The oil pump housing can define a pocket configured to receive the fixed displacement oil pump therein, a cavity in fluid communication with the pocket, and an oil pump outlet passage connecting the pocket to a first end of the cavity. The low pressure relief passage can be defined by the pump housing for selectively fluidly coupling the cavity to a pressure relief area defined by the pump housing and adapted to be in fluid communication with an oil sump of the engine. The high pressure relief passage can be defined by the pump housing for selectively fluidly coupling the cavity to the pressure relief area, the high pressure relief passage being separate from the low pressure relief passage. The annular pressure relief valve can be positioned in the cavity and can comprise a body having a first end, a second opposite end, a first internal bore extending from the valve first end, a second internal bore extending from the valve second end, and at least one slot extending through the body and in communication with the first internal bore. The first internal bore can face the first end of the cavity and can be separated from the second internal bore by an internal wall member. The at least one slot can include an arcuate shaped sidewall extending in an axial direction toward the internal wall member. The biasing member can be positioned in the second internal bore and can bias the pressure relief valve to a first position where the pressure relief valve engages the first end of the cavity. The pressure relief valve can be configured to overcome a biasing force of the biasing member and translate to a second position aligning the at least one slot with the low pressure relief passage to selectively provide low pressure relief to the oil pump in response to pressurized oil from the pump outlet passage that flows into the first internal bore and into engagement with the internal wall member being greater than a first predetermined pressure value. The pressure relief valve can be configured to further translate to a third position aligning the at least one slot with the high pressure relief passage to selectively provide high pressure relief to the oil pump in response to pressurized oil from the pump outlet passage being greater than a second predetermined pressure value. The second predetermined pressure value can be greater than the first predetermined pressure value.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DRAWINGS

Figure 7:
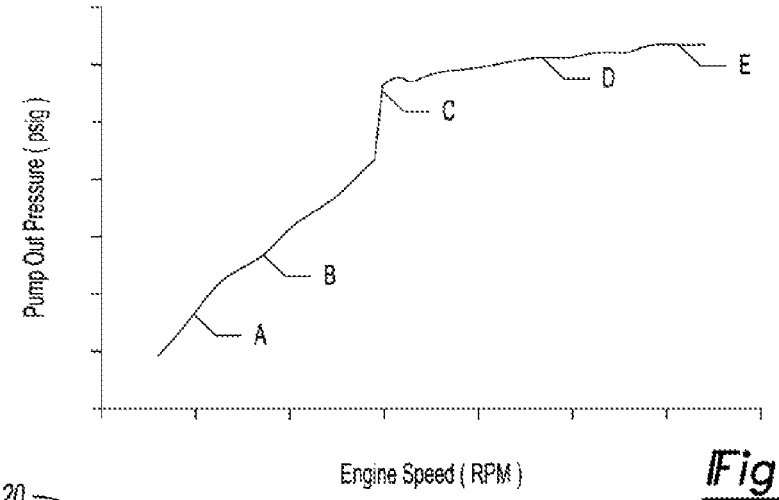

FIG. 7 is a diagram illustrating an exemplary pump output pressure vs. speed characteristic of the oil pump according to the principles of the present disclosure; and FIGS. 7A-7E are partial exemplary views of the pressure relief valve in various operational positions relative to the oil pump housing based on various engine operating conditions according to the principles of the present disclosure.

DETAILED DESCRIPTION

With initial reference to FIGS. 1-6, an exemplary oil pump system is provided having a pressure relief valve 10 for use in an oil pump housing 20 that is operably associated with an internal combustion engine. While the discussion will continue with reference to the internal combustion engine, it should be appreciated that the oil pump system can be used in other applications, including various types of engines and/or vehicles.

Figure 1:
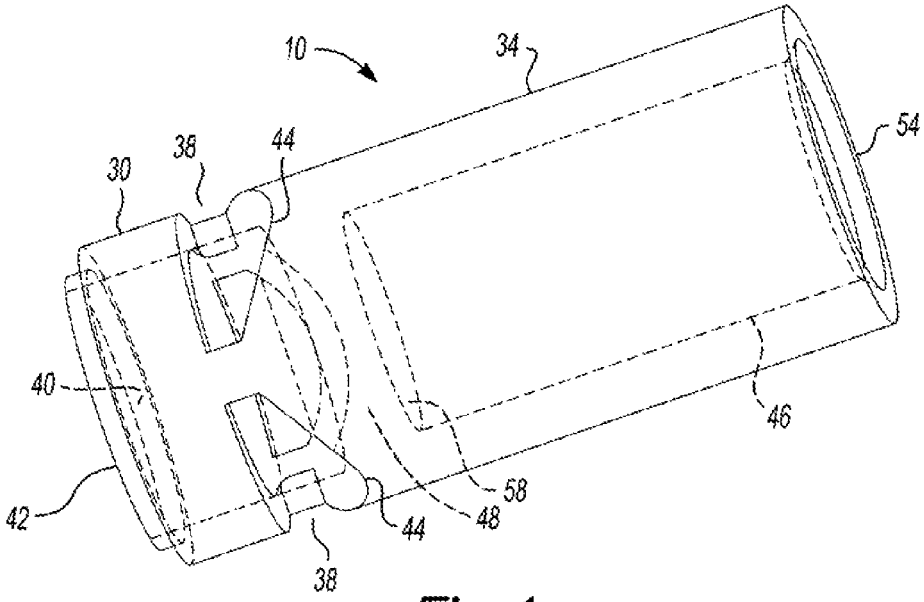
FIG. 1 is a perspective view of an exemplary pressure relief valve for an oil pump according to the principles of the present disclosure.
Figure 2:
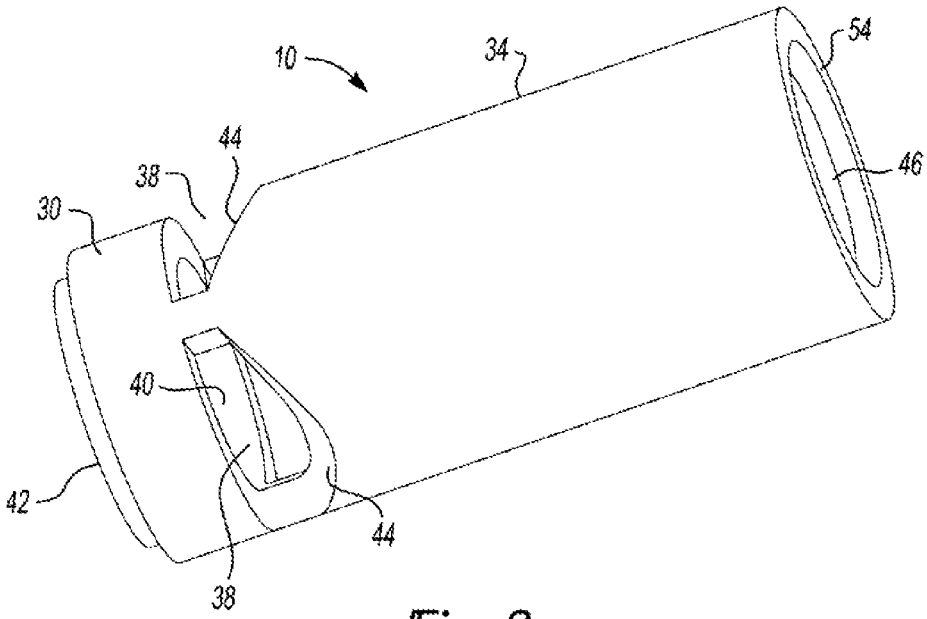
FIG. 2 is a perspective view of the exemplary pressure relief valve according to the principles of the present disclosure.

The pressure relief valve 10 includes a first body portion 30, a second body portion 34 and a plurality of slots or openings 38 positioned in the first body portion 30, as shown for example in FIGS. 1 and 2. Each of the plurality of openings 38 are in fluid communication with an internal bore 40 defined by the first body portion 30. In one exemplary configuration, internal bore 40 includes an open end 42 and a closed or opposite end formed by an internal wall member 48, as shown for example in FIG. 1. In this regard, it should be appreciated that the pressure relief valve 10 is a flow-through valve where lubricant (i.e., oil) can flow into and through internal bore 40 and selectively out openings 38, as will be discussed in greater detail below.

Each of plurality of openings 38 can include an arcuate shape 44 formed in the first body portion 30 and extending axially away from the open end 42. In one exemplary configuration, the plurality of openings 38 can be positioned adjacent wall member 48, as shown for example in FIG. 1. The second body portion 34 defines an internal blind bore 46 configured to receive a biasing member or spring 50 (FIG. 5) therein as will be described in greater detail below. Blind bore 46 includes an open end 54 and a closed end 58 formed by wall member 48. While the pressure relief valve 10 is shown having a cylindrical configuration, it should be appreciated that pressure relief valve 10 can be provided with other shapes in cross-section, as may be required based on design and or packaging constraints.

Figure 3A:
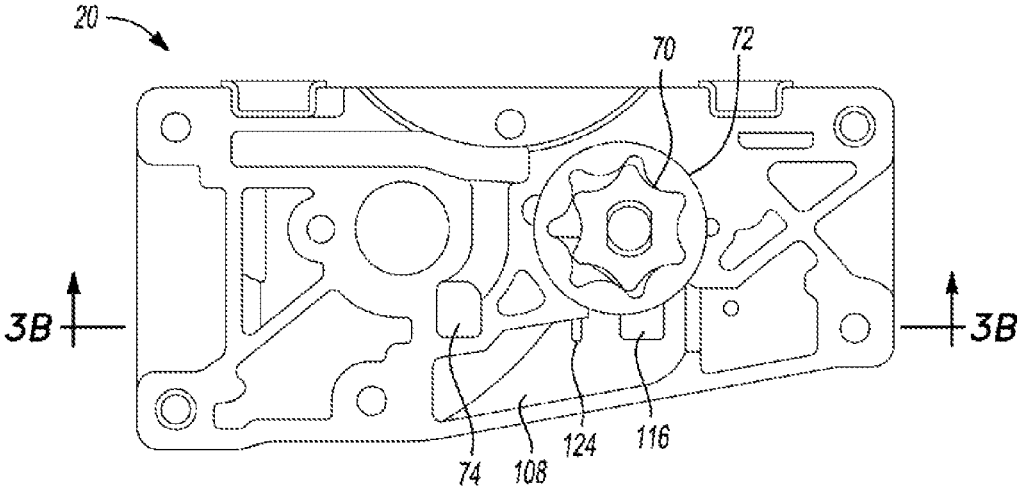
FIG. 3A is a partial view of a first side of an exemplary oil pump housing of the oil pump according to the principles of the present disclosure.
Figure 3B:
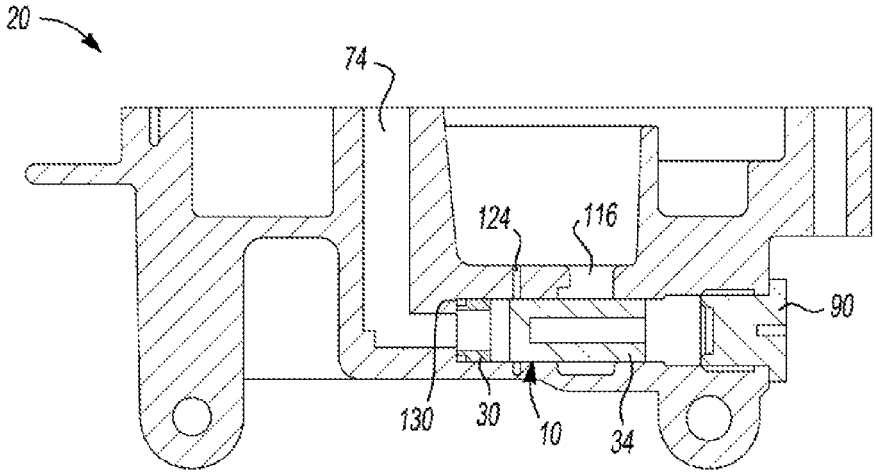
FIG. 3B is a sectional view of the exemplary oil pump housing of FIG. 3A along line 3B and including the exemplary pressure relief valve according to the principles of the present disclosure.

The oil pump housing 20 can include a pump, such as an exemplary fixed displacement rotary oil pump 70, positioned in a pocket 72 and configured to draw oil from a reservoir or sump of the internal combustion engine and output pressurized oil via a high pressure pump outlet 74, as shown in FIG. 3A. In one exemplary configuration, the oil pump housing 20 can include only the single high pressure pump outlet 74. Using one high pressure pump outlet can reduce the manufacturing complexity associated with multiple high pressure pump outlets, as well as reduce a need for a check valve being operatively associated with the multiple high pressure pump outlets.

High pressure pump outlet 74 is fluidly coupled to an internal bore or cavity 78 configured to house the pressure relief valve 10 therein. In one exemplary configuration, the high pressure pump outlet 74 can be coupled to a first end 82 of the cavity 78, as shown for example in FIGS. 4-6. The pressure relief valve 10 can be positioned in cavity 78 through a second end 86 and in an orientation such that first body portion 30 faces first end 82. Spring 50 is inserted into blind bore 46 through open end 54 such that one end of spring 50 engages wall member 48 and the other end extends through open end 54 and engages a plug or cap 90, as shown for example in FIG. 5. In one exemplary configuration, the plug 90 can be threadably received in pump housing 20 adjacent cavity 78 or in second end 86 of cavity 78.

Figure 4:
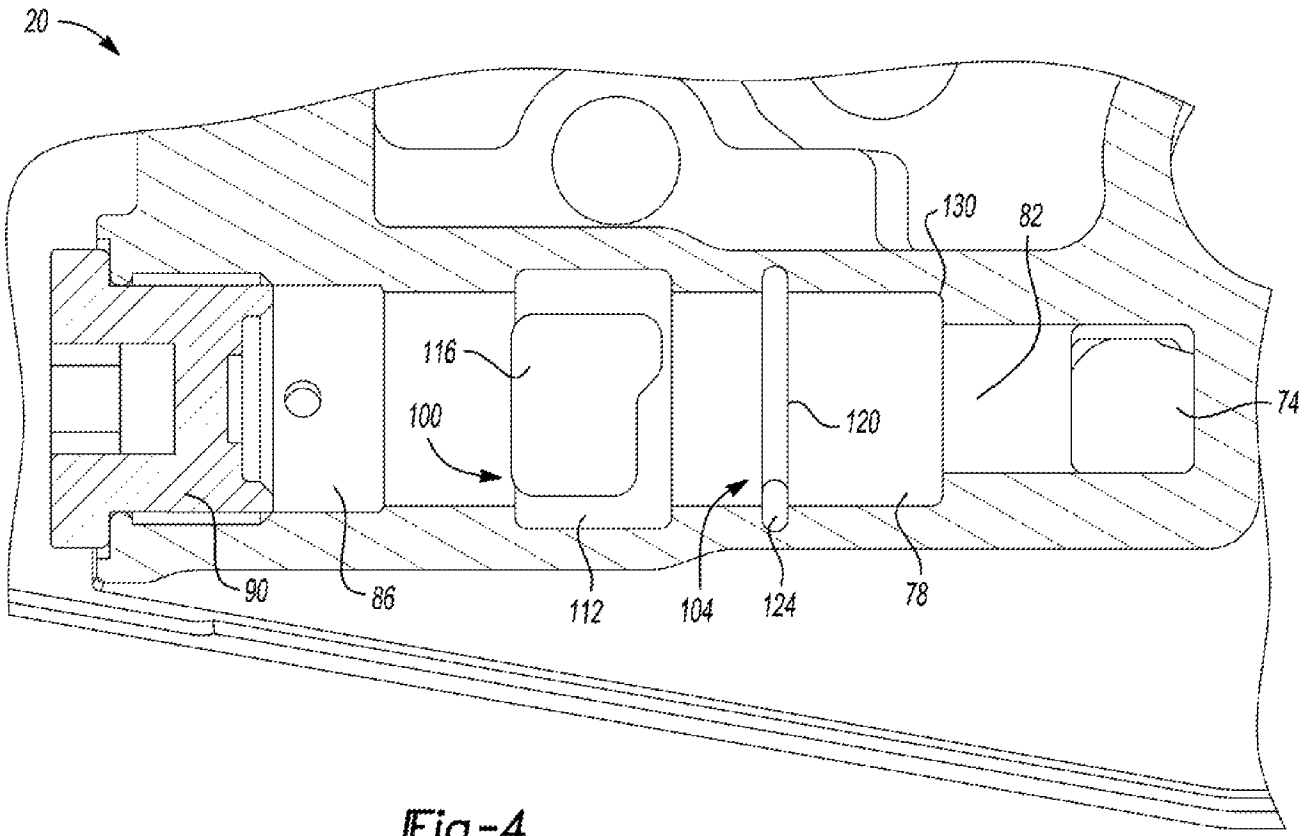
FIG. 4 is a partial sectional view of a second side of the exemplary oil pump housing according to the principles of the present disclosure.
Figure 5:
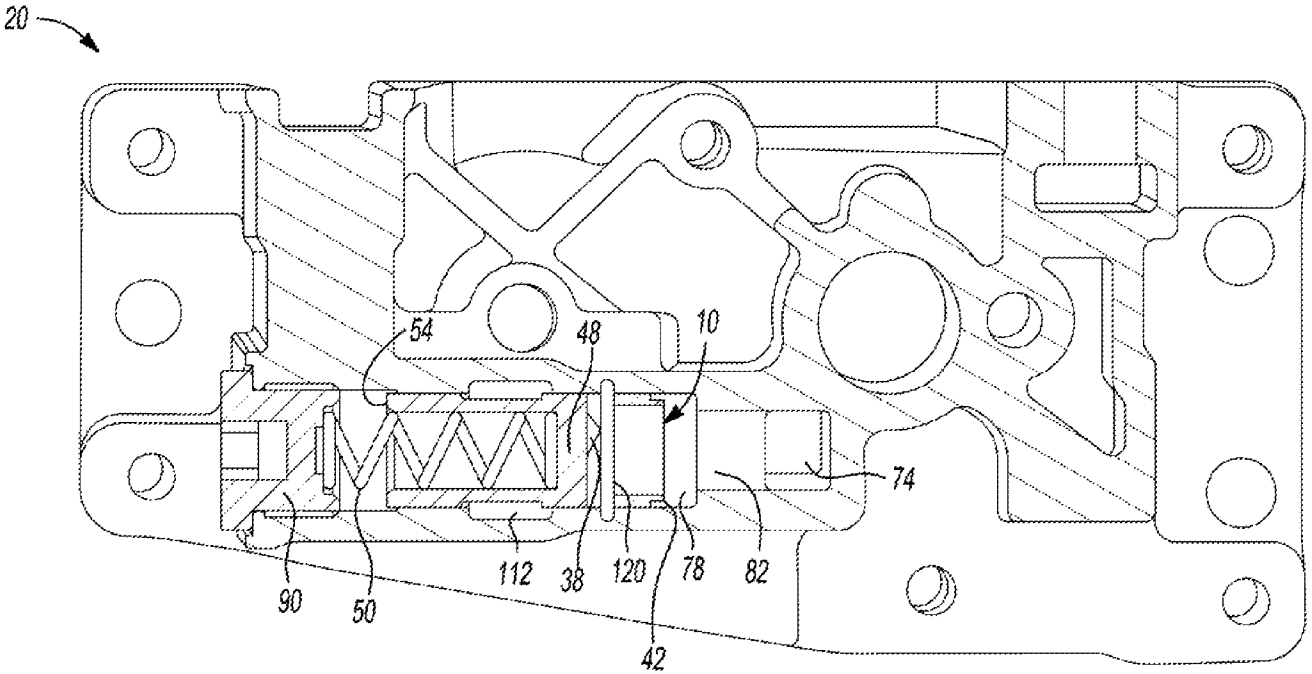
FIG. 5 is a partial sectional view of the second side of the exemplary oil pump housing and the exemplary pressure relief valve in a low pressure relief position according to the principles of the present disclosure.
Figure 6:
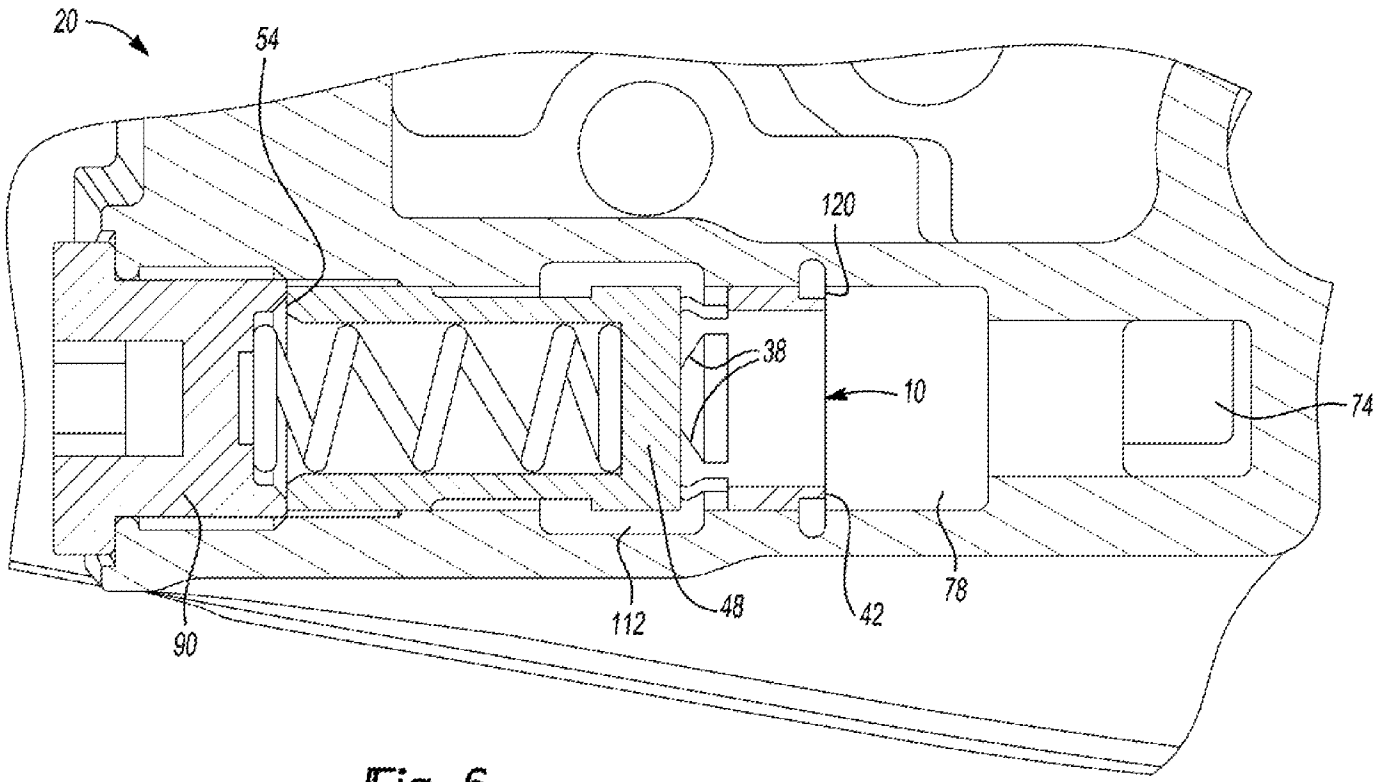
FIG. 6 is a partial sectional view of the second side of the exemplary oil pump housing and the exemplary pressure relief valve in a position providing both high pressure and low pressure relief according to the principles of the present disclosure.

With particular reference to FIG. 4, cavity 78 further includes a high pressure relief port 100 and a low pressure relief port 104. High pressure relief port 100 and low pressure relief port 104 are each fluidly coupled to an area 108 (FIG. 3A) of the pump housing 20 that is in fluid communication with the oil sump and thus an inlet to pump 70. High pressure relief port 100 includes an annular groove or relief 112 formed in cavity 78 and in fluid communication with a passage 116 that is in fluid communication with area 108. In a similar manner, low pressure relief port 104 includes an annular groove or relief 120 formed in cavity 78 and in fluid communication with a passage 124 that is likewise in fluid communication with area 108. In one exemplary configuration, the oil pump housing 20 can include only one high pressure relief port 100 and only one low pressure relief port 104.

While the annular relief 112 and passage 116 of pressure relief port 100 are both larger than the respective annular relief 120 and passage 124 of low pressure relief port 104, it should be appreciated that the relative sizes of the annular reliefs 112, 120 and associated respective passages 116, 124 can be varied based on engine design parameters, pump specifications, or combinations thereof. In addition, it should also be appreciated annular reliefs 112, 120 can be provided in a configuration other than annular, such as a partially circumferentially extending relief.

Pressure relief valve 10 is configured to have an outer surface that is complementary to an inner surface of cavity 78 such that pressure relief valve 10 can axially translate within cavity 78 while minimizing an amount of oil that can pass between the mating surface of the pressure relief valve 10 and cavity 78. Spring 50 provides a biasing force configured to urge pressure relief valve 10 to a rest or first position where first body portion 30 contacts a shoulder 130 adjacent high pressure pump outlet 74, as shown for example in FIG. 3B. In response to pressurized oil of a predetermined pressure being pumped into cavity 78, pressure relief valve 10 is configured to translate axially along cavity 78 against the bias force of spring 50 to selectively place the openings 38 in fluid communication with the high pressure or low pressure relief ports 100, 104 to thereby provide the respective selective high or low pressure relief to oil pump 70.

Figure 7A:
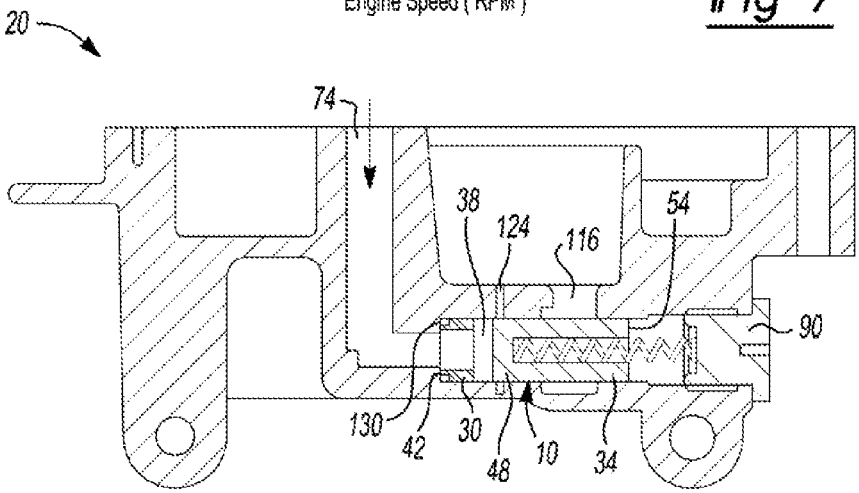

With additional reference to FIGS. 7-7E, operation of the oil pump system will now be discussed in greater detail. Initially, it is noted that FIGS. 7A-7E illustrate various views representing various positions of pressure relief valve 10 based on corresponding operating conditions (e.g., conditions A-E shown in FIG. 7) of an associated exemplary internal combustion engine. In this regard, it should be appreciated that the operating conditions of the internal combustion engine referenced in the graph of FIG. 7 are for discussion purposes only and can be varied as may be desired based on, for example, different exemplary engine displacements and/or calibrations.

In operation, spring 50 can bias pressure relief valve 10 to the first position abutting shoulder 130 in an operating condition A where the exemplary engine is operating at relatively low engine RPM or speed such that there is not sufficient oil pressure generated to overcome the biasing force of spring 50. This operating condition can be seen in FIGS. 7 and 7A where the openings 38 of pressure relief valve 10 are not in alignment with the high or low pressure relief ports 100, 104 such that pressure relief valve 10 does not provide pressure relief to pump 70 via ports 100, 104.

Figure 7B:
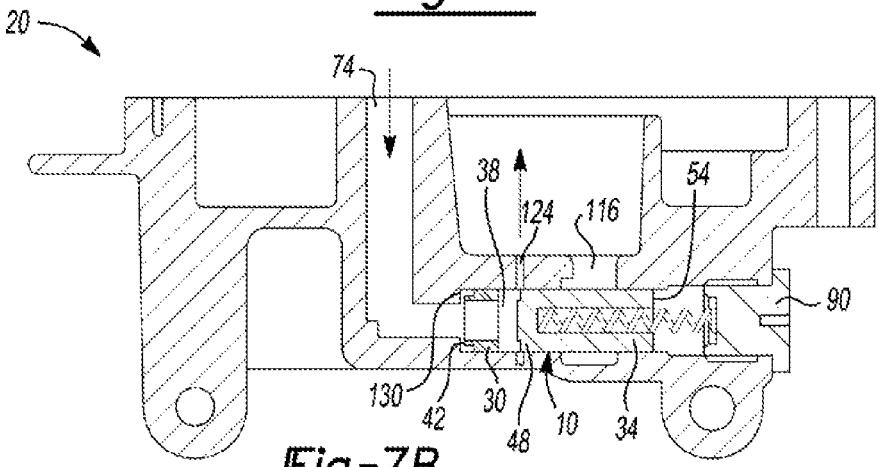

As the engine speed increases in operating condition B shown in FIG. 7, greater oil pressure is developed by oil pump 70 such that the pressurized oil received in cavity 78 is sufficient to overcome the bias force of spring 50 and translate pressure relief valve 10 toward second end 86 of cavity 78, as shown in FIG. 7B. Spring 50 is calibrated such that a predetermined oil pressure is sufficient to translate pressure relief valve 10 so that openings 38 begin to align with low pressure relief port 104 at a predetermined intermediate engine speed. In this regard, pressurized oil from pump 70 flows into cavity 78 and then through internal bore 40 of first body portion 30 and into engagement with wall member 48. The force of the pressurized oil acting against wall member 48 translates pressure relief valve 10 until the openings 38 begin to align with the low pressure relief port 104.

At this position, oil begins to flow from cavity 78 to area 108 via openings 38 and low pressure relief port 104 thereby providing low pressure relief to pump 70 at intermediate engine speeds. Providing low pressure relief at the intermediate engine speeds can reduce the work of pump 70, which can improve fuel economy.

The size of openings 38 in pressure relief valve 10 are configured to cooperate with the calibrated spring force to provide pressure relief over a specified pressure range of oil pump 70. In addition, the arcuate shape of openings 38 also provide for a gradual or staged amount of low pressure relief within the specified pressure range. More particularly, the arcuate shape of openings 38 extend in an axial direction so as to provide for an increasing amount of opening 38 being in communication with low pressure relief port 104 as the oil pressure increases over the specified pressure range and can provide a gradual or smooth transition into the desired pressure relief condition. In this manner, the amount of low pressure relief increases as the oil pressure increases over the specified pressure range.

Figure 7C:
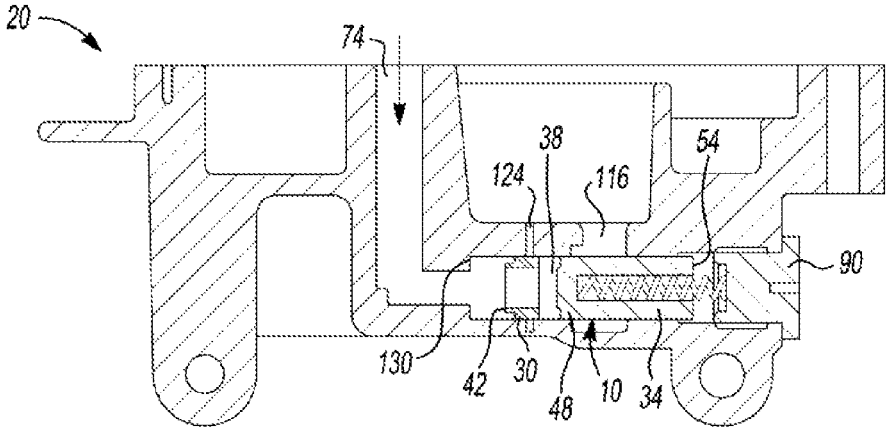

As the oil pressure continues to increase with the increasing engine speed shown in operating condition C of FIG. 7, the pressure relief valve 10 is urged beyond the low pressure relief port 104 such that openings 38 are no longer aligned with pressure relief port 104, as shown in FIG. 7C. In this operating condition C, pressure relief valve 10 again does not provide pressure relief to pump 70 via relief ports 100, 104. As shown in FIGS. 7A-7C, the pressure relief valve 10, spring 50 and low pressure relief port 104 are configured to be cooperate to activate pressure relief over the specified pressure range such that the low pressure relief port 104 is inactive above and below the specified pressure range for certain engine speeds.

Figure 7D:
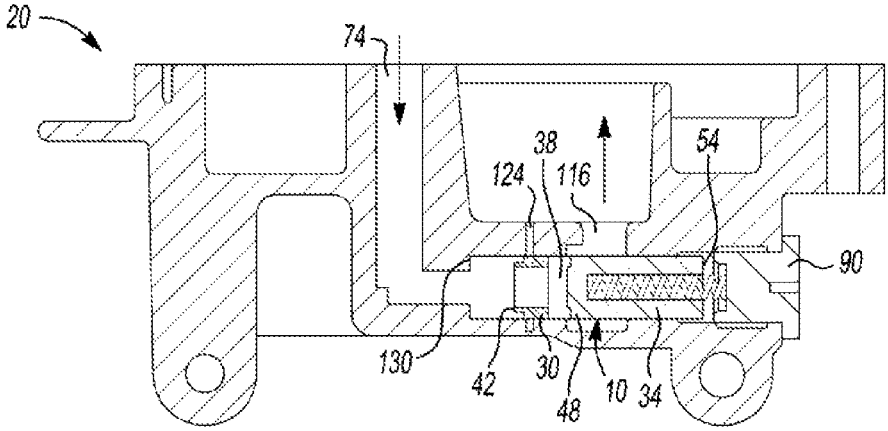
Figure 7E:
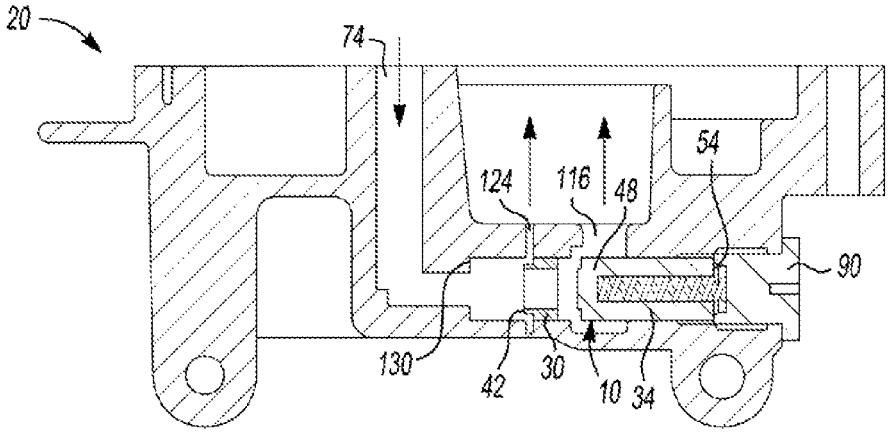

With reference to the operating condition D shown in FIGS. 7 and 7D, pressurized oil in cavity 78 is of a sufficient pressure such that pressure relief valve 10 is urged further toward second end 86 and the openings 38 begin to align with high pressure relief port 100. In this operating condition D, pressurized oil in cavity 78 is in fluid communication with area 108 via high pressure relief port 100 thereby providing high pressure relief to oil pump 70. The low pressure relief port is blocked by first body portion 30 such that low pressure relief is not available via port 104 in this operating condition.

As the engine speed increased beyond the operating condition D associated with FIG. 7D, the oil pressure increases in cavity 78 such that the pressure relief valve 10 is further translated until the second body portion 34 contacts second end 86 of cavity 78. In this operating condition E, full pressure relief is provided to pump 70 by both the high and low pressure relief ports 100, 104, as shown in FIG. 7E with reference to FIG. 7. In particular, openings 38 of pressure relief valve 10 are aligned with high pressure relief port 100 to provide high pressure relief to pump 70. Further, pressure relief valve 10 is sized relative to the position of low pressure relief port 104 in pump housing 20 such that in this operating condition the first body portion 30 is positioned beyond low pressure relief port 104. This provides for also placing low pressure relief port 104 in unobstructed fluid communication with cavity 78 to provide additional pressure relief to pump 70. In one exemplary configuration, first body portion 30 can be positioned between the high and low pressure relief ports 100, 104, as shown in FIG. 7E.

By providing high pressure relief at the operating condition D of the engine illustrated in FIG. 7D before providing full pressure relief with the addition of low pressure relief port 104 (FIG. 7E), a gradual or smoother transition to full pressure relief is provided. Such a gradual transition can provide for a more efficient oil pump operation.

The oil pump system of the present disclosure thus provides a low-cost pressure relief system using a minimal number of components to reduce complexity while providing both low and high pressure relief at calibrated pressure ranges. The oil pump system of the present disclosure further provides the advantage of being a passive system that eliminates a need for any external controls. The oil pump system of the present disclosure can utilize a fixed displacement pump as opposed to a variable displacement pump, thus reducing cost and complexity of the oil pump system. In one exemplary aspect, the pressure relief valve and associated ports and relief passages in pump housing 20 can be used with the fixed displacement oil pump 70 in lieu of the variable displacement pump to provide the variable pressure associated with the variable displacement pump while also reducing cost and complexity.

It should be understood that the mixing and matching of features, elements and/or functions between various examples may be expressly contemplated herein so that one skilled in the art would appreciate from the present teachings that features, elements and/or functions of one example may be incorporated into another example as appropriate, unless described otherwise above.

What is claimed is:

1. An oil pump system for an engine, comprising:

an oil pump housing defining a pocket configured to receive an oil pump therein, a cavity, and an oil pump outlet passage connecting the pocket to a first end of the cavity;

a low pressure relief passage defined by the pump housing for selectively fluidly coupling the cavity to a pressure relief area defined by the pump housing and adapted to be in fluid communication with an oil sump;

a high pressure relief passage defined by the pump housing for selectively fluidly coupling the cavity to the pressure relief area;

a pressure relief valve positioned in the cavity and comprising a body having a first end, a second opposite end, a first internal bore extending from the valve first end, a second internal bore extending from the valve second end, and at least one slot positioned in the body in communication with the first internal bore; and a biasing member positioned in the second internal bore and biasing the pressure relief valve to a first position;

wherein the pressure relief valve is configured to overcome a biasing force of the biasing member and translate to a second position aligning the at least one slot with the low pressure relief passage to selectively provide low pressure relief to the oil pump in response to pressurized oil from the pump outlet passage flowing into the first internal bore being greater than a first predetermined pressure value, and to further translate to a third position aligning the at least one slot with the high pressure relief passage to selectively provide high pressure relief to the oil pump in response to pressurized oil from the pump outlet passage being greater than a second predetermined pressure value.

2. The oil pump system of claim 1, wherein the pressure relief valve comprises an internal wall member separating the first and second internal bores from each other, the pressurized oil exerting a force against the internal wall member.

3. The oil pump system of claim 2, wherein the biasing member is positioned in the second internal bore in engagement with the internal wall member and a second end of the cavity.

4. The oil pump system of claim 3, further comprising a plug member threadably received in the second end of the cavity, the spring being in engagement with the plug member.

5. The oil pump system of claim 2, wherein the pressure relief valve comprises an annular member.

6. The oil pump system of claim 2, wherein the at least one slot includes a plurality of slots, each slot having at least one axially extending arcuate shaped sidewall, the arcuate shaped sidewalls configured to provide a staged alignment between the slots and the respective low and high pressure relief passages.

7. The oil pump system of claim 6, wherein the plurality of slots are positioned in the body axially between the internal wall member and the first end of the pressure relief valve.

8. The oil pump system of claim 2, wherein the low pressure relief passage includes an annular groove formed in the cavity.

9. The oil pump system of claim 2, wherein the low pressure relief passage is positioned a first axial distance from the first end of the cavity and the high pressure relief passage is positioned a second axial distance from the first end of the cavity, the second axial distance being greater than the first axial distance.

10. The oil pump system of claim 9, wherein when the pressure relief valve is in the second position, the high pressure relief passage is blocked by the body, and wherein when the pressure relief valve is in the third position, the low pressure relief passage is blocked by the body.

11. The oil pump system of claim 10, further comprising the pressure relief valve being configured to translate to a fourth position selectively allowing fluid communication between the cavity and the high and low pressure relief passages, the pressure relief valve being sized and shaped such that in the fourth position the at least one slot is aligned with the high pressure relief passage and the first end of the pressure relief valve is positioned axially beyond the low pressure relief passage.

12. The oil pump system of claim 1, wherein the oil pump comprises a fixed displacement oil pump, and wherein the oil pump housing includes only a single oil pump outlet passage.

13. The oil pump system of claim 1, wherein the high pressure relief passage is a separate passage from the low pressure relief passage.

14. The oil pump system of claim 1, wherein the first internal bore faces the first end of the cavity and is in fluid communication with the oil pump outlet passage, and wherein the first end of the pressure relief valve is biased into engagement with the first end of the cavity when in the first position.

15. An oil pump system for an engine, comprising:

a fixed displacement oil pump;

an oil pump housing defining a pocket configured to receive the fixed displacement oil pump therein, a cavity in fluid communication with the pocket, and an oil pump outlet passage connecting the pocket to a first end of the cavity;

a low pressure relief passage defined by the pump housing for selectively fluidly coupling the cavity to a pressure relief area defined by the pump housing and adapted to be in fluid communication with an oil sump of the engine;

a high pressure relief passage defined by the pump housing for selectively fluidly coupling the cavity to the pressure relief area, the high pressure relief passage being separate from the low pressure relief passage;

an annular pressure relief valve positioned in the cavity and comprising a body having a first end, a second opposite end, a first internal bore extending from the valve first end, a second internal bore extending from the valve second end, and at least one slot extending through the body and in communication with the first internal bore, the first internal bore facing the first end of the cavity and being separated from the second internal bore by an internal wall member, the at least one slot including an arcuate shaped sidewall extending in an axial direction toward the internal wall member; and a biasing member positioned in the second internal bore and biasing the pressure relief valve to a first position where the pressure relief valve engages the first end of the cavity;

wherein the pressure relief valve is configured to overcome a biasing force of the biasing member and translate to a second position aligning the at least one slot with the low pressure relief passage to selectively provide low pressure relief to the oil pump in response to pressurized oil from the pump outlet passage that flows into the first internal bore and into engagement with the internal wall member being greater than a first predetermined pressure value, and to further translate to a third position aligning the at least one slot with the high pressure relief passage to selectively provide high pressure relief to the oil pump in response to pressurized oil from the pump outlet passage being greater than a second predetermined pressure value, the second predetermined pressure value being greater than the first predetermined pressure value.

16. The oil pump system of claim 15, further comprising a plug member positioned in a second opposite end of the cavity, the biasing member positioned in the second internal bore in engagement with the internal wall member and the plug member.

17. The oil pump system of claim 15, wherein the at least one slot comprises a plurality of separate slots circumferentially spaced around the body and in communication with the first internal bore, each slot being positioned axially between the internal wall member and the valve first end and including the arcuate shaped sidewall configured to provide a staged alignment between the slots and the respective low and high pressure relief passages.

18. The oil pump system of claim 15, further comprising the pressure relief valve being configured to translate to a fourth position selectively allowing fluid communication between the cavity and the high and low pressure relief passages, the pressure relief valve being sized and shaped such that in the fourth position the at least one slot is aligned with the high pressure relief passage and the first end of the pressure relief valve is positioned axially beyond the low pressure relief passage; and wherein when the pressure relief valve is in the second position, the high pressure relief passage is blocked by the body, and wherein when the pressure relief valve is in the third position, the low pressure relief passage is blocked by the body.

19. The oil pump system of claim 15, wherein the low pressure relief passage includes an annular groove formed in a wall of the cavity, and wherein the pump outlet passage includes only a single pump outlet passage.

* * * * *